United States Patent [19]

Carson

[11] Patent Number: 4,551,235

[45] Date of Patent: Nov. 5, 1985

[54] UTILITY CONSERVATION IN HYDROGEN RECYCLE CONVERSION PROCESSES

[75] Inventor: Don B. Carson, Mt. Prospect, Ill.

[73] Assignee: UOP Inc., Des Plaines, Ill.

[21] Appl. No.: 625,415

[22] Filed: Jun. 28, 1984

Related U.S. Application Data

[62] Division of Ser. No. 374,857, May 4, 1982, Pat. No. 4,477,413.

[51] Int. Cl.[4] ..... C10G 45/72; C10G 47/36; C10G 49/26; C10G 35/24

[52] U.S. Cl. ..... 208/100; 208/DIG. 1; 208/107; 208/108; 208/133; 208/134; 208/142; 208/143; 208/209; 208/213; 585/250; 585/483; 585/486; 585/616; 585/654

[58] Field of Search ..... 208/DIG. 1, 108, 100, 208/103, 105, 107, 133, 134, 142, 143, 209, 213; 585/250, 483, 616, 654

[56] References Cited

U.S. PATENT DOCUMENTS 3,248,317 4/1966 Pohlenz et al. ..... 208/112
3,306,841 2/1967 Ward ..... 208/108
3,607,091 9/1971 Boyd ..... 208/59
3,972,804 8/1976 McLaughlin et al. ..... 208/108

*Primary Examiner*—D. E. Gantz
*Assistant Examiner*—O. Chaudhuri
*Attorney, Agent, or Firm*—Thomas K. McBride; William H. Page, II; Richard J. Cordovano

[57] ABSTRACT

There is disclosed a system for measuring and controlling the concentration of hydrogen in hydrogen recycle processes used in oil refineries and petrochemical plants. The system is intended to reduce the amount of hydrogen and hydrocarbon vapor circulating in such systems, thus reducing the quantity of utilities needed to operate such systems. Specifically, there is a savings of compressor power and fuel required for heating. The system is dependent on the recognition that a decrease in cooling medium temperature results in an increase in hydrogen flow, which can be decreased to the minimum permissible without endangering catalyst activity and stability and product yield if hydrogen concentration is monitored, and that partial pressure is the key parameter.

8 Claims, 2 Drawing Figures

UTILITY CONSERVATION IN HYDROGEN RECYCLE CONVERSION PROCESSES

CROSS REFERENCE TO RELATED APPLICATION

This is a divisional application of pending application Ser. No. 374,857 filed on May 4, 1982, now U.S. Pat. No. 4,477,413.

BACKGROUND OF THE INVENTION

This invention relates to conservation of utilities in hydrogen recycle processes used in oil refineries and petrochemical plants. More specifically, the invention relates to a method of reducing hydrogen recycle flow and thus reducing heating load and compression load in hydrogen recycle processes. Hydrogen recycle processes can be classified into two types: those which produce hydrogen and those which consume hydrogen. Examples of hydrogen-producing processes are catalytic reforming and the various dehydrogenation processes. Hydrogen-consuming processes include hydrogenation, hydrodealkylation, hydrodesulfurization, hydrocracking, and isomerization. FIGS. 1 and 2, which are presented herein as examples, show the basic flow arrangement of most hydrogen recycle processes. A circulating gas flow consisting mainly of hydrogen and including hydrocarbon vapors is maintained in the equipment loop by means of a compressor. Several streams are added to and removed from the loop. It is desirable to maintain the concentration of hydrogen in the reactor above a certain minimum value for each particular process in order to protect catalyst activity and stability and/or product yield structure. These minimum values are known to those skilled in the art by means of experimental data which has been collected by them. If the hydrogen concentration falls below the minimum value in a process where the reactor contains catalyst, the result will be excessive deposit of coke on the catalyst, premature deactivation of the catalyst, and reduction of product yield. In those processes which do not utilize a catalyst, the hydrogen concentration must be maintained above the minimum value in order to protect the yield structure, that is, to maximize the amount of desired product produced by the processing unit and minimize the production of undesirable by-products. A standard method for maintaining the required minimum hydrogen concentration is for an operator of the hydrocarbon processing unit to monitor the quantity of circulating gas flowing by means of a flow indicator and manually accomplish compressor capacity adjustment. An alternative method is to use an automatic controller to monitor the quantity of circulating gas flowing and adjust the capacity of the compressor to maintain the quantity flowing at an appropriate value above the minimum. However, total circulating gas flow is not the variable which it is necessary to control, thus the desired flow value must be set higher than necessary to ensure the existence of an adequate safety margin for hydrogen content of the circulating gas flow.

In addition, variations in cooling efficiency lead to an excessive circulating gas flow. The cooling medium used in the cooler, which is part of the equipment loop shown in FIGS. 1 and 2, is water or ambient air. The temperature of the cooling medium varies with weather conditions and time of day and can vary from hour to hour. As the cooling medium temperature falls, a larger quantity of hydrocarbon vapor condenses out of the cooled stream, thus causing the concentration of hydrogen in the circulating stream to increase. The average molecular weight of the circulating gas stream decreases as hydrogen concentration increases. The flow meter used is normally of the orifice type. As can be seen from an inspection of the well-known orifice flow meter equation and the example presented herein, a lower molecular weight of the circulating gas stream results in a lower flow reading, which is false. This lower flow reading causes the operator or automatic controller to increase compressor capacity or output in order to bring the flow reading back up to its proper value. However, the flow reading is not an accurate indication of hydrogen concentration, because of the changed molecular weight, and the effect is an increase in circulating gas flow which is not necessary to protect the catalyst and does not serve any other desired purpose. Even though a decrease in cooling medium temperature causes an increase in hydrogen concentration, in the absence of instrumentation to show this, it is not possible to act on the decrease, and in fact, it is necessary to adjust the compressor to raise the flow rate back to its former value in order to ensure protection of the catalyst and yield structure. Thus a decrease in the temperature of a cooling medium which is capable of varying from hour to hour results in an unnecessarily large circulating gas flow. The excess circulating gas must be heated and compressed. Reducing the circulating gas flow will result in a decrease in utility usage required to accomplish this. It is possible to control circulating gas composition at a constant value by regulating the quantity of cooling medium passed through the cooler. However, this is not usually a desirable option, since a colder cooling medium yields a colder gas-liquid separator, which enhances liquid product recovery and the purity of the circulating gas. Also, a colder gas-liquid separator results in less hydrogen being dissolved in the liquid product stream and therefore lost from the system.

The art which has been discovered which is closest to the instant invention is disclosed by Bajek and McLaughlin in U.S. Pat. Nos. 3,974,064 and 3,972,804. These patents present a comprehensive control scheme for hydrogen recycle processes. The instant invention can be considered an improvement on those inventions. Those effects of changes in cooling medium temperature which are adverse are recognized and control action is taken to mitigate them. The key process parameter of partial pressure is recognized and used to initiate control action. An excessively large safety margin in hydrogen concentration is not necessary.

BRIEF SUMMARY OF THE INVENTION

It is an object of this invention to provide a means of reducing utility usage in hydrogen recycle processes by reducing the amount of gas which must be circulated and thereby reducing energy required to heat and compress the circulating gas. The concentration of hydrogen is obtained and used to adjust the output of the compressor so that the concentration of hydrogen is at the minimum required to protect the catalyst and/or maintain the yield structure. In one of its broad aspects, the present invention embodies a method consisting of (a) monitoring the concentration of hydrogen in a hydrogen recycle process; (b) comparing said concentration of hydrogen to a previously established value; and (c) adjusting the output of a compressor in response to said comparison to provide a concentration of hydrogen which is equal to said previously established value. In a more specific embodiment of the present invention, the concentration of hydrogen in the reactor is expressed in terms of partial pressure and is obtained by means of measuring the total pressure of the feed stream, measuring the mole fraction of hydrogen in the feed stream, then multiplying mole fraction times total pressure, the product being partial pressure. Other objects and embodiments will become apparent upon consideration of this entire specification.

BRIEF DESCRIPTION OF THE DRAWINGS

FIG. 1 depicts a mode of practicing the invention in a hydrogen-consuming process wherein a partial pressure detection apparatus is used to measure the concentration of hydrogen. FIG. 2 depicts a mode of practicing the invention in a hydrogen-producing process wherein the partial pressure of hydrogen is calculated from measurements of total pressure and mole fraction. Note that the dashed lines represent transmission of control signals to and from items of control hardware and that solid lines drawn to the circles representing instruments denote pipelines containing process fluid.

DETAILED DESCRIPTION OF THE INVENTION

Figure 1:
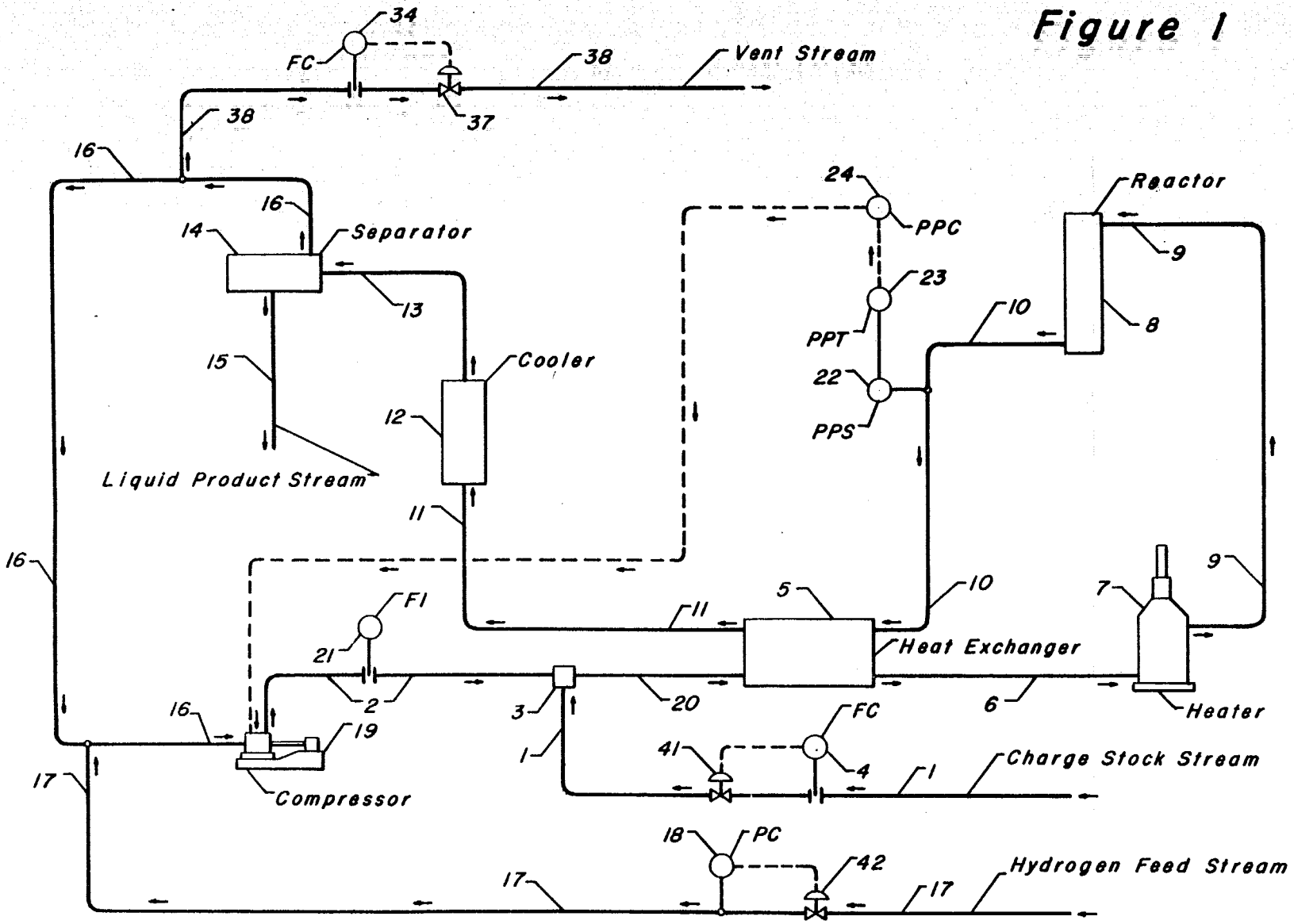
FIGS. 1 and 2 depict typical flow schemes for hydrogen recycle processes used in oil refineries and petrochemical plants.
Figure 2:
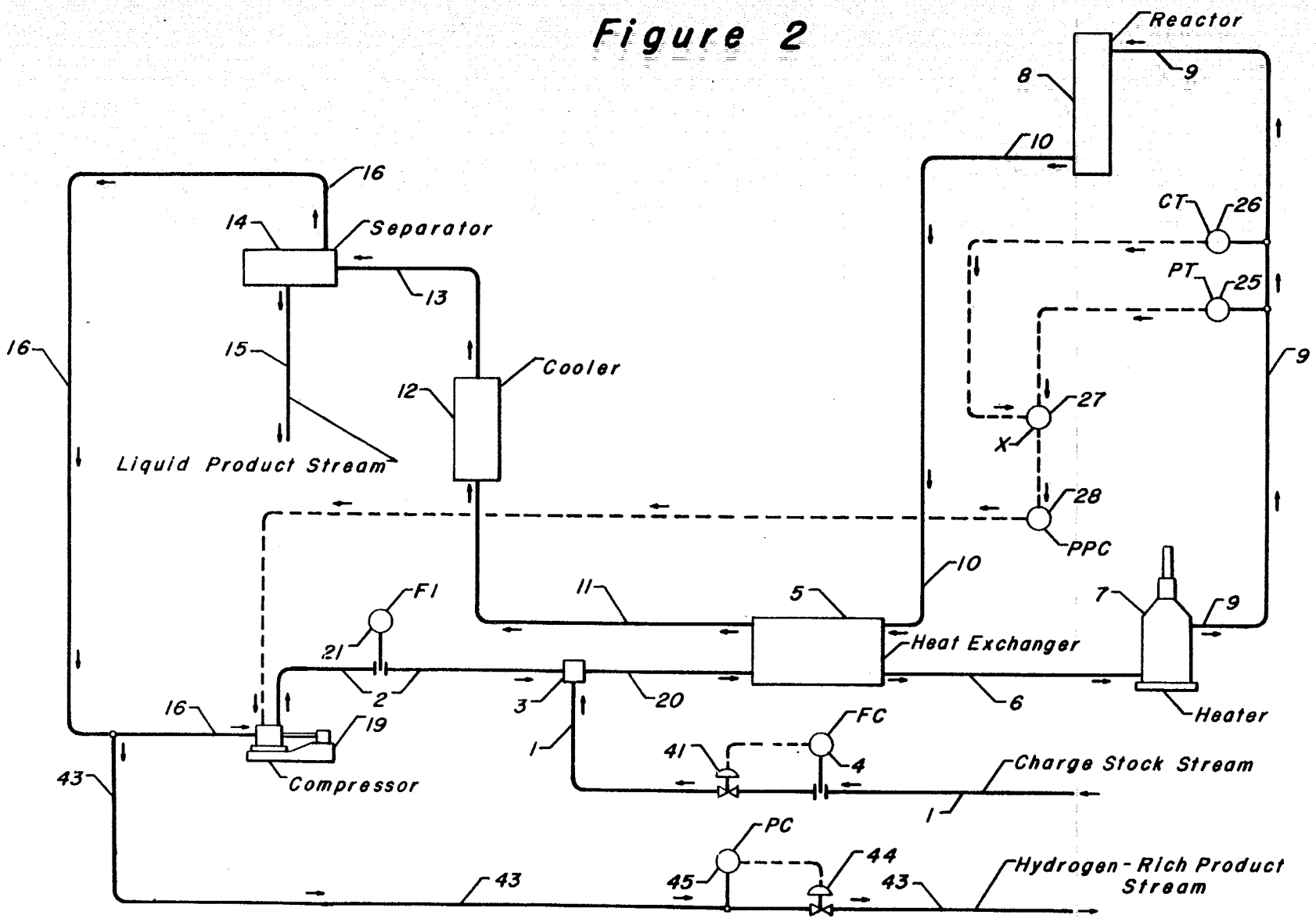

The further description of this invention is presented with reference to the schematic drawings, FIGS. 1 and 2. The drawings are not intended as an undue limitation on the generally broad scope of the invention as set out in the claims. Only those compressors, heaters, heat exchangers, and coolers are shown that are useful in the description of the process. The depiction of other miscellaneous hardware such as pumps, instrumentation and controls, and valves has been omitted as not essential to a clear understanding of the process, the use of such hardware being well within the purview of one skilled in the art.

In FIG. 1, a charge stock stream enters the processing unit through pipeline 1 and is mixed with circulating gas flowing in pipeline 2 by means of mixing pipeline section 3 to form a reactor feed stream in pipeline 20. The rate of charge stock addition is controlled at a particular preset value by flow controller 4 and flow control valve 41. The circulating gas stream flowing in pipeline 2 consists mainly of hydrogen but includes hydrocarbon vapors. The reactor feed stream flows through pipeline 20 to regenerative heat exchanger 5, where it is heated, and then through pipeline 6 to heater 7. The feed stream is heated further in heater 7 and then flows through pipeline 9 to reactor 8, where the desired reactions take place. The effluent stream produced in reactor 8 flows through pipeline 10 to regenerative heat exchanger 5 where it is cooled by giving up its heat to the reactor feed stream. From regenerative heat exchanger 5, the product stream flows through pipeline 11 to cooler 12 where it is further cooled by means of a cooling medium which is water or ambient air. As a result of this cooling, liquid hydrocarbons are condensed. The effluent stream flows from cooler 12 through pipeline 13 to gas-liquid separator 14 where it separates into two streams—a liquid product stream which flows out of the hydrocrabon processing unit through pipeline 15 and a hydrogen and hydrocarbon vapor stream, a portion of which flows through pipeline 16 to compressor 19. Pipeline 17 is connected to pipeline 16 and is used to supply hydrogen to the hydrocarbon processing unit from a source outside of the unit. Pressure controller 18 and pressure control valve 42 regulate the addition of hydrogen so that a constant preset pressure will be maintained at the suction of compressor 19. As hydrogen is consumed in the reactor, the pressure decreases, causing the valve to open to allow hydrogen to flow into the hydrocarbon processing unit. Flow indicator 21 provides a measurement of gas flow at the outlet of compressor 19; however, it is accurate only at one particular set of operating conditions, as explained earlier. Hydrogen and hydrocarbon vapor flow out of the hydrocarbon processing unit through pipeline 38. The flow is controlled by flow control valve 37 and flow controller 34 to a value set by the plant operator. The vent flow is made necessary by the presence of light hydrocarbons in the circulating gas stream. Some light hydrocarbons enter the system through pipeline 17 as part of the hydrogen feed stream, which is not pure hydrogen, and some are produced in side reactions taking place in reactor 8. While some of the light hydrocarbons leave the system dissolved in the liquid product stream, there is usually an increase in concentration over time unless a vent stream is employed. Thus the purpose of the vent stream is to remove light hydrocarbons from the process, as they would interfere with the desired reactions. The principle is similar to that of cooling tower blow-down, where a continuous stream of water is withdrawn to keep water hardness at an acceptably low level. The vent stream usually contains 60 mole percent or more of hydrogen.

FIG. 1 shows the instrumentation necessary to practice an embodiment of the invention. Hydrogen concentration can be expressed as partial pressure of hydrogen. The partial pressure of hydrogen in the effluent stream in pipeline 10 is measured by a partial pressure sensor 22 such as that disclosed by H. A. Hulsberg in U.S. Pat. Nos. 2,671,336 and 2,671,337. Pressure transmitter 23, of conventional design, is used in conjunction with the partial pressure sensor 22 and provides a signal to a conventional automatic controller 24 which adjusts compressor capacity to maintain a preset value of hydrogen partial pressure. Compressor capacity is changed by adjusting inlet guide vanes or adjusting the speed of the compressor. Thus only the amount of hydrogen is circulated that is required to meet the minimum necessary to protect the catalyst and/or maintain the yield structure. By means of reducing the hydrogen flow, the power needed by the compressor driving means is reduced and the quantity of fuel burned to provide heat at heater 7 is reduced. Each of the equipment items shown in FIGS. 1 and 2 may consist of several individual pieces of equipment. For example reactor 8 may consist of a single vessel or may consist of several reaction vessels with provisions to reheat the process stream between vessels. Also, equipment may be added to this basic flow scheme. For example, the circulating gas stream may be passed through equipment designed to remove hydrogen sulfide. These variations and additions to the basic simple schematic are well known to those skilled in the art of hydrocarbon processing.

FIG. 2 differs from FIG. 1 in that, since it depicts a hydrogen-producing process, the hydrogen feed stream and vent stream are replaced by a single hydrogen removal stream and a different embodiment of the invention is depicted. Hydrogen produced in the reactor is removed by removing a portion of the hydrogen and hydrocarbon vapor stream flowing from gas-liquid separator 14 by means of pipeline 43. Pressure controller 45 and pressure control valve 44 regulate the removal of gas so that a constant preset pressure will be maintained at the suction of compressor 19. As hydrogen and hydrocarbon vapors are generated, the pressure increases, causing the valve to open to allow gas to flow out of the hydrocarbon processing unit. In the embodiment of the invention depicted in FIG. 2, the pressure in pipeline 9 is sensed by a conventional pressure transmitter 25. The mole fraction of hydrogen in pipeline 9 is sensed by concentration transmitter 26, which may be a conventional thermal conductivity analyzer such as the 7C series sold by Beckman Instruments, Inc. The product of pressure times mole fraction, which is partial pressure, is obtained in multiplying relay 27. Automatic controller 28 adjusts the capacity of compressor 19 to maintain a preset value of partial pressure. As in FIG. 1 the concentration of hydrogen is set at the minimum value, thus accomplishing conservation of utilities.

In FIG. 1, the sensing point for hydrogen concentration is downstream of the reactor 8, at pipeline 10, rather than upstream of the reactor as shown in FIG. 2. Since the reaction of FIG. 1 consumes hydrogen, the hydrogen concentration will decrease from the inlet to the outlet of the reactor means. The point of lowest hydrogen concentration will be at the outlet of the reactor means, i.e., in the reactor effluent stream. In contrast, in a hydrogen-producing process such as that of FIG. 2, the point of lowest hydrogen concentration will be at the entrance to the reactor means. The hydrogen concentration should be measured at the point where it is expected to be lowest in order to achieve the goal of maintaining as low as possible a concentration in order to conserve utilities while still protecting the catalyst and/or yield structure. In some cases, it may be desirable to vary the location of the hydrogen concentration sensor while keeping it downstream of the reactor means. The sensor can be located in pipeline 10 on pipeline 11. The reason for changing sensor location would normally be to expose it to less severe conditions. The considerations involved in choice of sensor location are familiar to those skilled in the art. For example, it must not be placed in pipeline 11 if liquid drops condense out in heat exchanger 5. The method of measuring hydrogen content is totally independent of sensing location. For example, a partial pressure sensor as disclosed in the Hulsberg patents and an associated pressure transmitter can be used in place of pressure transmitter 25 and concentration transmitter 26 in FIG. 2.

The functions performed by the automatic controllers and arithmetic relays shown in FIGS. 1 and 2 can be accomplished by a digital computer which would receive process measurements and provide control signals in place of the automatic controllers and arithmetic relays. The method of practicing the invention is not changed by substitution of a digital computer for the automatic controllers and arithmetic relays and the depiction of controllers and relays in the Figures can be taken as showing computer functions. With use of a digital computer, different control algorithms are possible which might prove more efficient under certain circumstances. Control by a digital computer or microprocessor-based control units are included within the scope of this invention.

It is important to note that partial pressure is the parameter most relevant to protection of catalyst and yield structure. The invention can be practiced using any convenient method of measuring hydrogen concentration. However, for maximum precision, concentration of hydrogen should be expressed in terms of partial pressure. In the context of this invention, partial pressure is considered to be a form of expression of concentration. Often, the concentration of hydrogen can be measured by any convenient means without any loss of precision, since system pressure is relatively constant. But mole fraction, volume percent, and the like, do not completely correlate with improvement of catalyst activity and stability and yield. Pressure must be taken into account. If the amount of hydrogen in the circulating gas stream is held constant and the pressure is increased, the partial pressure of hydrogen increases. Catalyst activity and stability and yield will be improved by the pressure increase, though percent hydrogen has not changed.

The following example will illustrate the utility savings which are available from the practice of the instant invention. The following Table presents certain operating parameters for a hydrogen recycle process, more specifically a catalytic reforming unit processing 10,000 barrels per day of naphtha charge stock.

| | CASE A | CASE B | CASE C |
|---|---|---|---|
| Separator Temperature, °F. | 100 | 80 | 80 |
| Orifice DP, inches water | 42 | 42 | 36 |
| Circulating Gas, lb-mol/hr | 5,271 | 5,623 | 5,215 |
| Circulating Gas, mol. % Hydrogen | 86.9 | 87.8 | 87.8 |
| Circulating Hydrogen, lb-mol/hr | 4,579 | 4,936 | 4,579 |
| Circulating Gas, mol. wt. | 6.82 | 6.18 | 6.18 |
| Circulating Gas, lb/hr | 35,940 | 34,570 | 32,207 |
| Heating Load, $10^6$ BTU/hr | BASE | +0.211 | −0.349 |
| Compression Load, HP | BASE | +116 | −38 |

Case A shows parameters when the unit shown in FIG. 2 is operating with the design maximum cooling medium temperature, at which the gas-liquid separator 14 operating temperature will be 1OO° F. Orifice DP is the measured pressure drop across the orifice plate at flow indicator 21 and is the value which is converted into flow rate by means of the flow indicator scale. The circulating gas and circulating hydrogen parameters are all taken at pipeline 2. The heating load refers to heat which is supplied to heater 7. Compression load refers to the power required to drive compressor 19.

Case B shows the parameters when the cooling medium temperature is such that gas-liquid separator 14 is operating at 80° F. and the invention is not practiced. Orifice pressure drop is maintained at the same value as Case A by an operator or automatic controller. The amount of hydrogen in the circulating gas stream is increased from Case A. The heating load and compression load is increased from Case A.

Case C shows the same parameters when the cooling medium temperature is the same temperature as Case B but where the invention is practiced. The heat decrease over Case B is 560,000 BTU/hr; allowing for firing inefficiencies, this results in fuel savings of approximately 700,000 BTU/hr. The power savings over Case B is 154 horsepower. On a yearly basis, at realistic 1981 rates of $5.00 per million BTU's, and $350.00 per horsepower-year, and assuming 11 months operation at conditions which average out to Case C conditions, practice of this invention results in a cost savings of approximately $77,500.00 in this relatively small reforming unit. Reforming units of six times the capacity of this unit have been built.

I claim as my invention:

1. A control method for reducing the flow of hydrogen in hydrocarbon conversion apparatus, thereby reducing heating load and compression load in said conversion apparatus, where said conversion apparatus comprises (1) an inlet conduit for transporting a charge stock stream, which inlet conduit is in interconnection with a conduit for transporting a vaporous hydrocarbon-hydrogen recycle stream; (2) a reaction zone for reacting hydrocarbonaceous materials comprising said charge stock stream to form a converted hydrocarbon effluent stream, which reaction zone is in communication with said vaporous hydrocarbon-hydrogen recycle stream conduit; (3) a reaction zone effluent conduit having a hydrogen partial pressure sensor therein, said effluent conduit containing said converted hydrocarbon effluent stream; (4) a cooling zone for cooling said converted hydrocarbon effluent stream to provide, via condensing, a liquid hydrocarbon product stream and at least a portion of said vaporous hydrocarbon-hydrogen recycle stream; (5) a cooling zone effluent conduit in communication with a gas-liquid separation zone, said gas-liquid separation zone effective to separate said liquid hydrocarbon product stream from said vaporous hydrocarbon-hydrogen recycle stream; and (6) a compressor means having variable output capability in communication with said separation zone via a separation zone vaporous effluent conduit and also in communication with said recycle stream conduit; said control method consisting of:

(a) sensing the partial pressure of hydrogen at a point downstream of said reaction zone in said reaction zone effluent conduit;

(b) comparing said partial pressure of hydrogen to a previously determined value and developing a signal correlating thereto;

(c) transmitting said signal to said variable output compressor; and (d) controlling the quantity of vaporous hydrocarbon and hydrogen recycled to said reaction zone, via said recycle stream conduit, in accordance with said signal, such that when said partial pressure is higher than said previously determined value, the output of said compressor is decreased, and when said partial pressure is lower than said previously established value, the output of said compressor is increased.

2. The method of claim 1 further characterized in that said hydrocarbon reaction zone is a hydrogenation unit.

3. The method of claim 1 further characterized in that said hydrocarbon reaction zone is a hydrodealkylation unit.

4. The method of claim 1 further characterized in that said hydrocarbon reaction zone is a hydrodesulfurization unit.

5. The method of claim 1 further characterized in that said hydrocarbon reaction zone is a hydrocracking unit.

6. A control method for reducing the flow of hydrogen in hydrocarbon conversion apparatus, thereby reducing heating load and compression load in said conversion apparatus, where said conversion apparatus comprises (1) an inlet conduit for transporting a charge stock stream, which charge stream inlet conduit is in interconnection with a conduit for transporting a vaporous hydrocarbon-hydrogen recycle stream; (2) a reaction zone inlet stream conduit in communication with said vaporous hydrocarbon-hydrogen recycle stream conduit and a reaction zone, said inlet stream conduit having a means to sense the partial pressure of hydrogen contained therein; (3) said reaction zone for reacting hydrocarbonaceous materials comprising said charge stock stream to form a converted hydrocarbon effluent stream; (4) a cooling zone in communication with said reaction zone, via a reaction zone effluent conduit, for cooling and condensing said converted hydrocarbon effluent from said reaction zone to form a liquid hydrocarbon product stream and at least a portion of said vaporous hydrocarbon-hydrogen recycle stream; (5) a gas-liquid separation zone in communication with said cooling zone, via a cooling zone effluent conduit, for separating said liquid hydrocarbon product stream from said vaporous hydrocarbon-hydrogen recycle stream; and (6) a compressor means having variable output capability in communication with said separation zone via a separation zone vaporous effluent conduit and also in communication with said reaction zone inlet conduit via said hydrocarbon-hydrogen recycle conduit, where said recycle conduit is connected at one end to said compressor means and at the other end to said reaction zone inlet conduit; said control method consisting of:

(a) sensing the partial pressure of hydrogen at a point within said reaction zone inlet stream conduit;

(b) comparing said partial pressure of hydrogen to a previously determined value and developing a signal correlating thereto;

(c) transmitting said signal to said variable output compressor; and (d) controlling the quantity of vaporous hydrocarbon and hydrogen recycled to said reaction zone, via said recycle stream conduit, in accordance with said signal, such that when said partial pressure is higher than said previously determined value, the output of said compressor is decreased, and when said partial pressure is lower than said previously established value, the output of said compressor is increased.

7. The method of claim 6 further characterized in that said reaction zone is a catalytic reforming unit.

8. The method of claim 6 further characterized in that said reaction zone is a dehydrogenation unit, in which unit hydrogen is removed from a hydrocarbonaceous charge stock to produce a product containing less hydrogen than said charge stock.

* * * * *